United States Patent [19]

Risi

[11] 4,163,686

[45] Aug. 7, 1979

[54] LABELLING MACHINE FOR APPLYING A LABEL, IN PARTICULAR A SEALING BAND, TO A CONTAINER

[75] Inventor: Roberto Risi, Casalecchio Di Reno, Italy

[73] Assignee: MA.CO S.a.s. di Saso Vittorio & C., Casalecchio Di Reno, Italy

[21] Appl. No.: 802,931

[22] Filed: Jun. 2, 1977

[30] Foreign Application Priority Data

Jun. 11, 1976 [IT] Italy ..... 3462 A/76

[51] Int. Cl.[2] ..... B65C 3/20

[52] U.S. Cl. ..... 156/492; 156/DIG. 15

[58] Field of Search ..... 156/476, 477 R, 482, 156/488, 489, 490, 491, 492, 493, DIG. 15, DIG. 17

[56] References Cited

U.S. PATENT DOCUMENTS

| | | | |
|---|---|---|---|
| 1,246,006 | 11/1917 | Stake | 156/476 |
| 2,371,265 | 3/1945 | Ray | 156/492 |

FOREIGN PATENT DOCUMENTS

| | | | |
|---|---|---|---|
| 20158 | of 1914 | United Kingdom | 156/488 |

*Primary Examiner*—William A. Powell
*Assistant Examiner*—William H. Thrower
*Attorney, Agent, or Firm*—Guido Modiano; Albert Josif

[57] ABSTRACT

A labelling machine for applying a label, in particular a sealing band, to a container comprises a carousel pivotable about a vertical axis, whereon a frame is supported such as to be movable parallel to the vertical axis. The frame defines a seat having an opening for allowing the placing of a label on the container top and the folding of the opposed laps of the label down along the sides of the container by folding members carried by the carousel.

2 Claims, 9 Drawing Figures

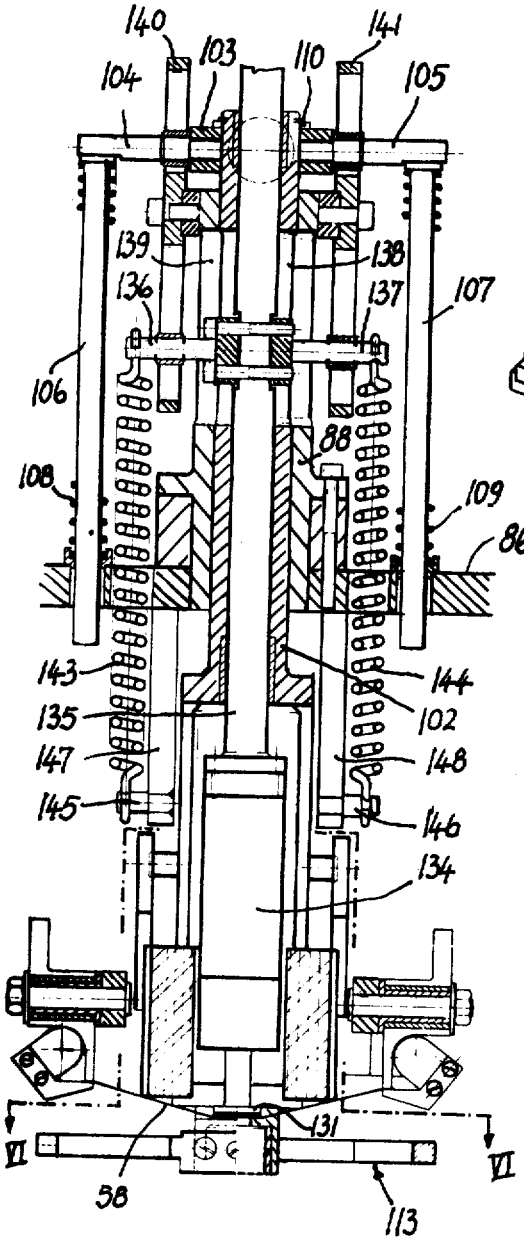
Fig. 2
Fig. 5
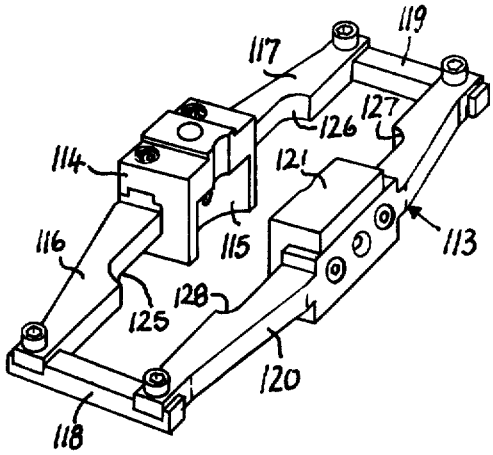
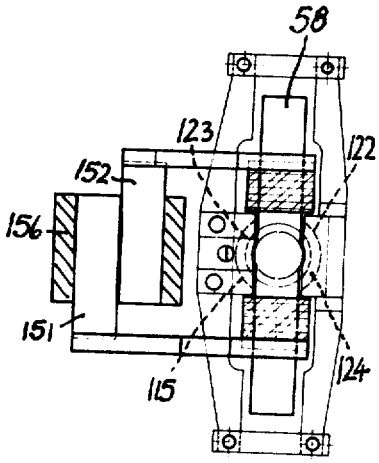
Fig. 6

LABELLING MACHINE FOR APPLYING A LABEL, IN PARTICULAR A SEALING BAND, TO A CONTAINER

BACKGROUND OF THE INVENTION

This invention relates to a labelling machine for applying a label, in particular a sealing band, to a container. The invention is specially useful in applying so-called fiscal bands or strips to bottles.

As is known, spirit or alcoholic beverage containing bottles are generally required to carry a fiscal band or strip which, in addition to proving conformity with the applicable revenue or taxation, also acts as a seal to warrant the integrity of the bottle contents. Such a fiscal band is thus applied astride the bottle cap, that is such that from a portion of the band disposed diametrically across the cap top there depend downwardly two laps that are glued to the neck of the bottle.

The application of the fiscal band with currently available labelling machines of the carousel type brings about some serious problems, especially as regards the supporting of the bottle during the step of laying the fiscal band onto the cap. In fact, none of the carousel labelling machines currently available on the market can help clamping the bottle between an end plate, whereon the bottle is made to rest, and a pad which is pressed against the upper mouth of the bottle.

SUMMARY OF THE INVENTION

It is a primary object of this invention to provide a labelling machine of the carousel type, whereby it becomes feasible to apply a sealing band to a wide range of container designs with but minor modifications.

This object is achieved by a labelling machine for applying a label, in particular a sealing band, to a container, characterized in that it comprises a carousel pivotable about a vertical axis, whereon a frame is supported such as to be movable parallel to said axis, said frame defining a seat adapted to be superimposed on top of a container being carried by said carousel, said seat having an opening for allowing the placing of a label on the container top and the folding of the opposed laps of said label down along the sides of the container by means of folding members carried by said carousel.

BRIEF DESCRIPTION OF THE DRAWINGS

Further features will be more clearly apparent from the following detailed description of some preferred embodiments of the machine according to this invention, illustrated by way of example in the accompanying drawings, where:

FIG. 2 is an elevational view along the section line II—II of FIG. 1;

FIG. 5 is a perspective view of the frame which supports the bottle at the top and allows the application of the fiscal band;

FIG. 6 is a plan view taken along the line VI—VI of FIG. 1;

DESCRIPTION OF THE PREFERRED EMBODIMENTS

Figure 1:
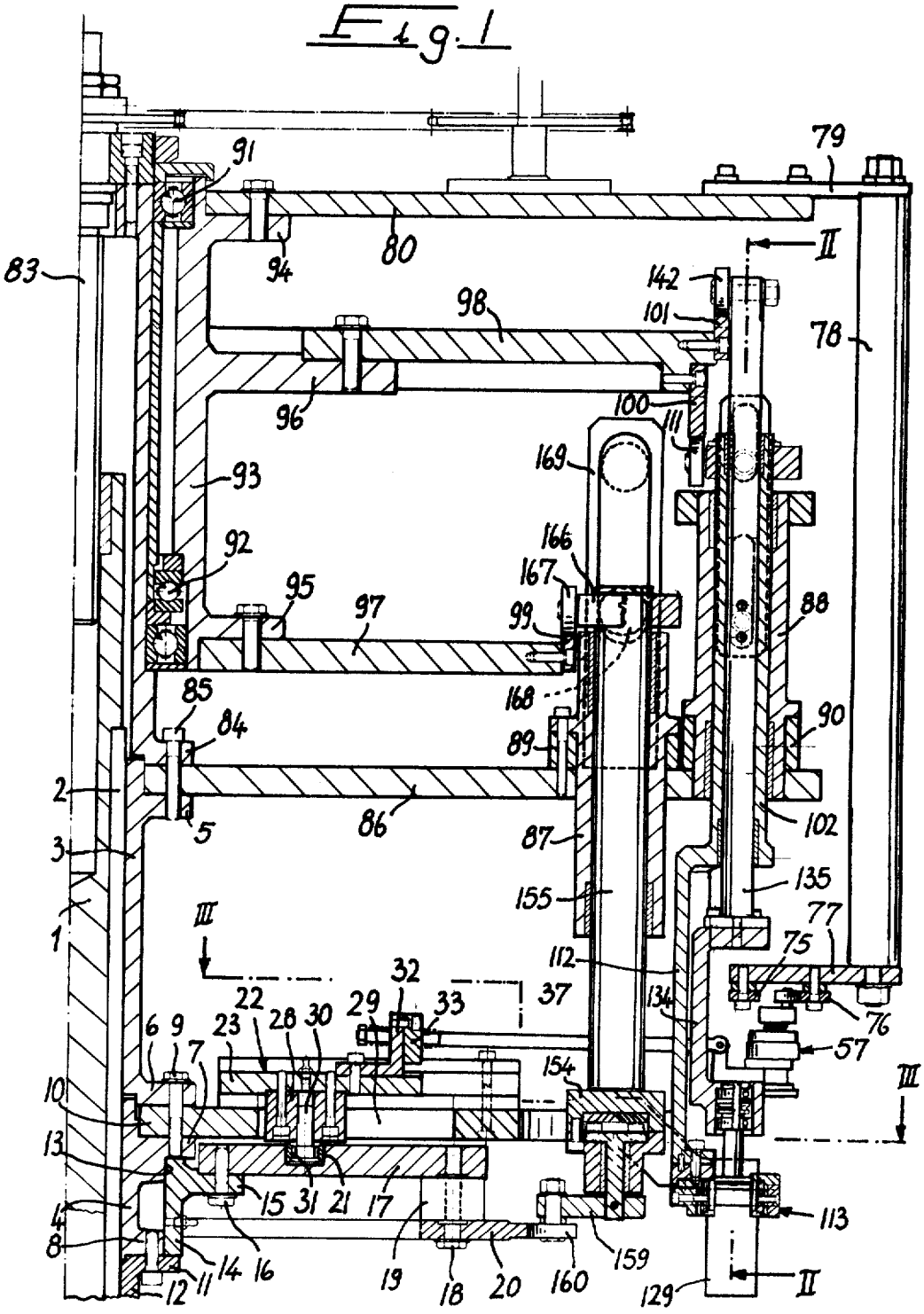
FIG. 1 is an elevational view, on a vertical section plane, of the upper portion of a labelling machine for applying a fiscal band to the neck of a bottle.

With reference to FIG. 1, the labelling machine according to this invention is of the so called carousel type, i.e. pivotable about a vertical shaft. The vertical shaft is indicated at 1 and projects upwards from a base, not shown, to be driven of rotary motion.

To the shaft 1 there is affixed, in a longitudinal seat, a key 2 whereto are rotatively engaged a tube 3 and an adapter 4 centered coaxially in the tube 3. The tube 3 and adapter 4 have, at opposed ends, flanges 5, 6 and 7, 8.

Between the flanges 6 and 7, there is clamped by means of bolts 9, a plate 10, and under the flange 8 the flange 11 of a sleeve 12 is attached, the sleeve 12 being also rotatively rigid with the shaft 1. The flange 11 has its peripheral edge projecting outwards beyond the edge of the flange 8, thereby, between the flanges 7 and 11 and the outer surface of the adapter 4, a seat 13 is defined, wherein is located a ring 14 provided with a collar 15. To such a collar 15, there is attached by means of bolts 16, a stationary disk 17 which, through arms not shown, is made rigid with the base or fixed parts deriving therefrom. In actual practice, then, during the machine operation, the plate 10 is moving with respect to the disk 17.

Below the disk 17, at a peripheral area, a radial cam 20 is secured by means of bolts 18 and with the interposition of angularly scattered spacers 19. A further radial cam is formed in the upper face of the disk 17 and comprise a closed loop groove 21 extending along a suitable path all around the shaft 1.

The cam 20 controls, as will be explained hereinafter, the folding members consisting of pads arranged to fold down the label, which in this embodiment is the fiscal band or label, onto the bottle neck, while the cam 21 controls the movements of members effective to position the fiscal band onto the bottle cap.

Such members comprise a slide, generally indicated at 22, consisting of a plate 23 having its side edges in sliding engagement with grooves 24,25 of a pair of guides 26,27 affixed to the plate 10 such as to allow a radial displacement of the slide 22. Below the plate 23, there is secured a block 28 which, during the displacement movements of the slide 22, is enabled to move into a radially elongated opening 29 formed in the plate 10 between the guides 26. A pin 30 engages with the block 28 which, below the block 29, carries a roller 31 engaging slidably in the groove 21.

Figures 3, 4:
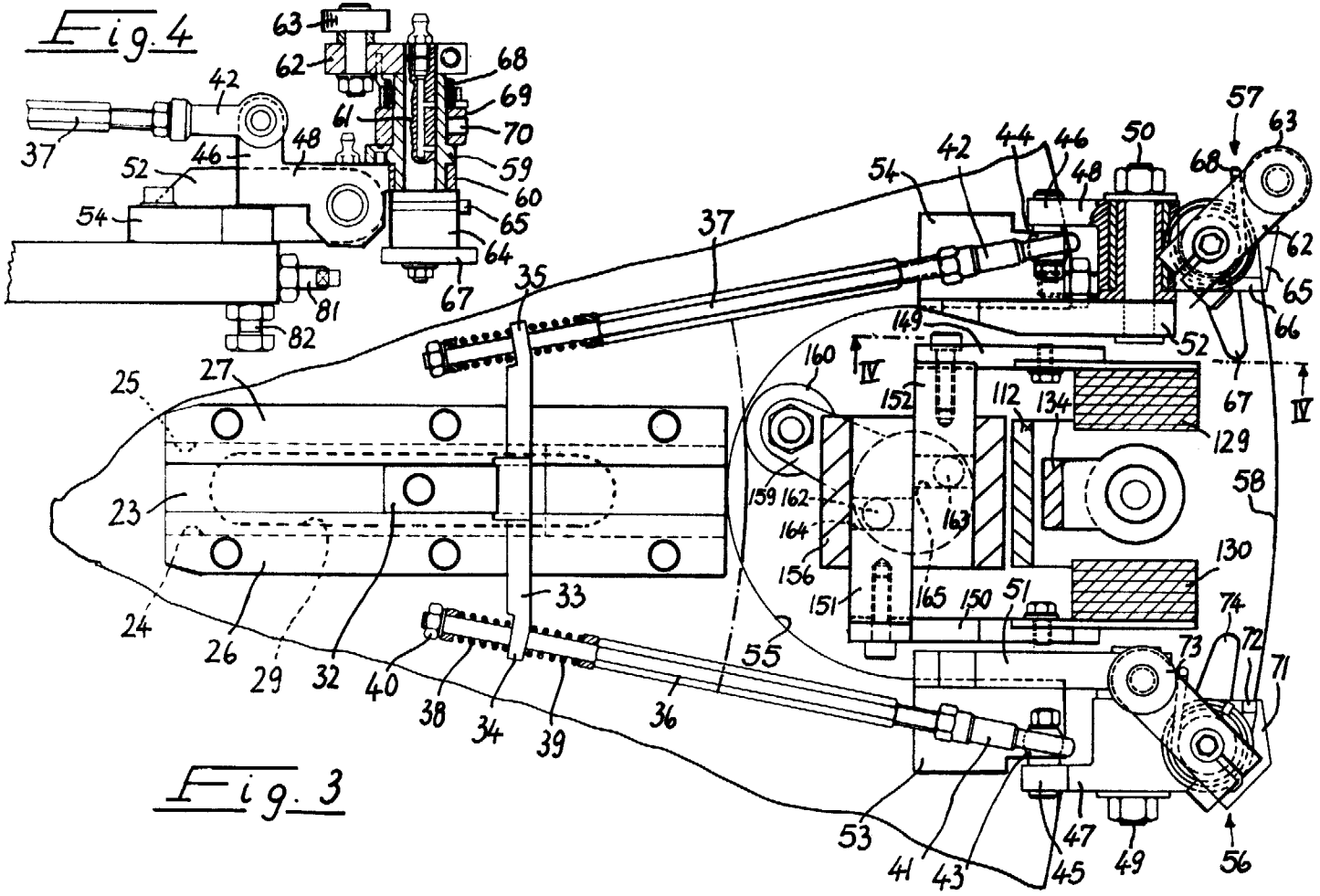
FIG. 3 is a partial plan view taken along the line III—III of FIG. 1.
FIG. 4 is an elevational view taken along the line IV—IV of FIG. 3.

An angle bar element 32 is attached to the plate 23, to the vertical portion whereof a horizontal rod 33 is secured transversally, the opposed ends whereof are formed with two eyes 34,35. Two rods 36,37, acting as tie bars, go through the eyes 34,35 (FIG. 3) and are elastically linked to the latter by means of spring pairs 38,39, the first whereof intervenes between the eyes 34,35 and the nuts 40 screwed onto the ends of the rods 36,37, while the second spring intervenes between the eyes 34,35 and shoulders in the rods 36,37.

The rods 36,37 are convergent toward the shaft 1 and at their farther apart ends carry couplings of the ball joint type. More specifically, the eye elements 41,42 of such couplings are rigid with the rods 36,37, ball elements 43,44 being attached to lugs 45,46 which are bent upwards from respective levers 47,48. Such levers are pivoted, by means of pivot pins 49,50, to wings 51,52 of gussets 53,54 attached to the plate 10. The pivot pins 49,50 are coaxial to each other and the gussets 53,54 are located close to the edge of the plate 10, on each side of a semicircular opening 55, which is open to the outside and adapted to allow the pads therethrough, the pads being intended to fold the fiscal band onto the bottle neck during their vertical movement.

The levers 47,48 support two clamp members, generally indicated at 56,57, which are effective to clamp the ends of a fiscal band 58 picked up from a magazine where it is laid on a vertical plane, and then, by rotation of the clamps about the pins 49,50, to position such a band in a horizontal lay upon the cap or bottle top.

The clamp member 57 comprises (FIG. 4) a sleeve 59 vertically centered in a hole in a bracket 60 of the lever 48 and attached to the latter. In the sleeve 59, there is a pivotable pin 61 to the end whereof projecting above the sleeve there is keyed a radial arm 62 whereon an idle roller 63 is mounted cantilever fashion.

The lower end of the pin 61 is provided with a boss 64 whereto a plate is attached which forms a finger 65, the finger being suitable to be caused to contact a projection 66 formed under the bracket 60. The finger 65 and the projection 66 make up the clamp intended to grip one end of the fiscal band. Under the boss 64, a cam 67 is affixed. As the roller 63, by contacting a cam having its radial extension around the shaft 1, causes the clamps 65,66 to open to grip one end of the band 58 during the withdrawal thereof from the magazine, the cam 67 is actuated by specially provided supporting elements of the pads, such as to cause the clamps 65,66 to open after the band has been positioned onto the cap and allow the band to be folded astride the bottle neck by the pads.

The clamping or gripping force for the clamps 65,66 is derived from a torque spring 68, one end whereof is hooked up to the arm 62 and the other end to a ring 69 mounted rigidly to the sleeve 59 for rotation therewith through a dowel 70. It should be noted that the ring 69 may be rotated about the sleeve prior to its engagement by the dowel 70 in order to permit the torque of the spring 68 to be adjusted, and accordingly also the adjustment of the pressure which is being applied to the finger 65 against the projection or lug 66.

The structure of the clamp member 56 is identical to the one just described with reference to the clamp member 57, excepting that, whereas the opening of the clamps 65,66 which grip one end of the fiscal band, is obtained by abutment of the roller 63 onto the inner edge of an outer cam, the opening of the equivalent clamps 71,72 of the member 56, which grip the opposed end of the fiscal band, is obtained by abutment of the roller 73 (equivalent of the roller 63) onto the outer edge of an inner cam. Furthermore, to open the clamps 71,72 in order to release the fiscal band onto the bottle top, there is provided a cam 74, identical to the cam 67.

Figure 7:
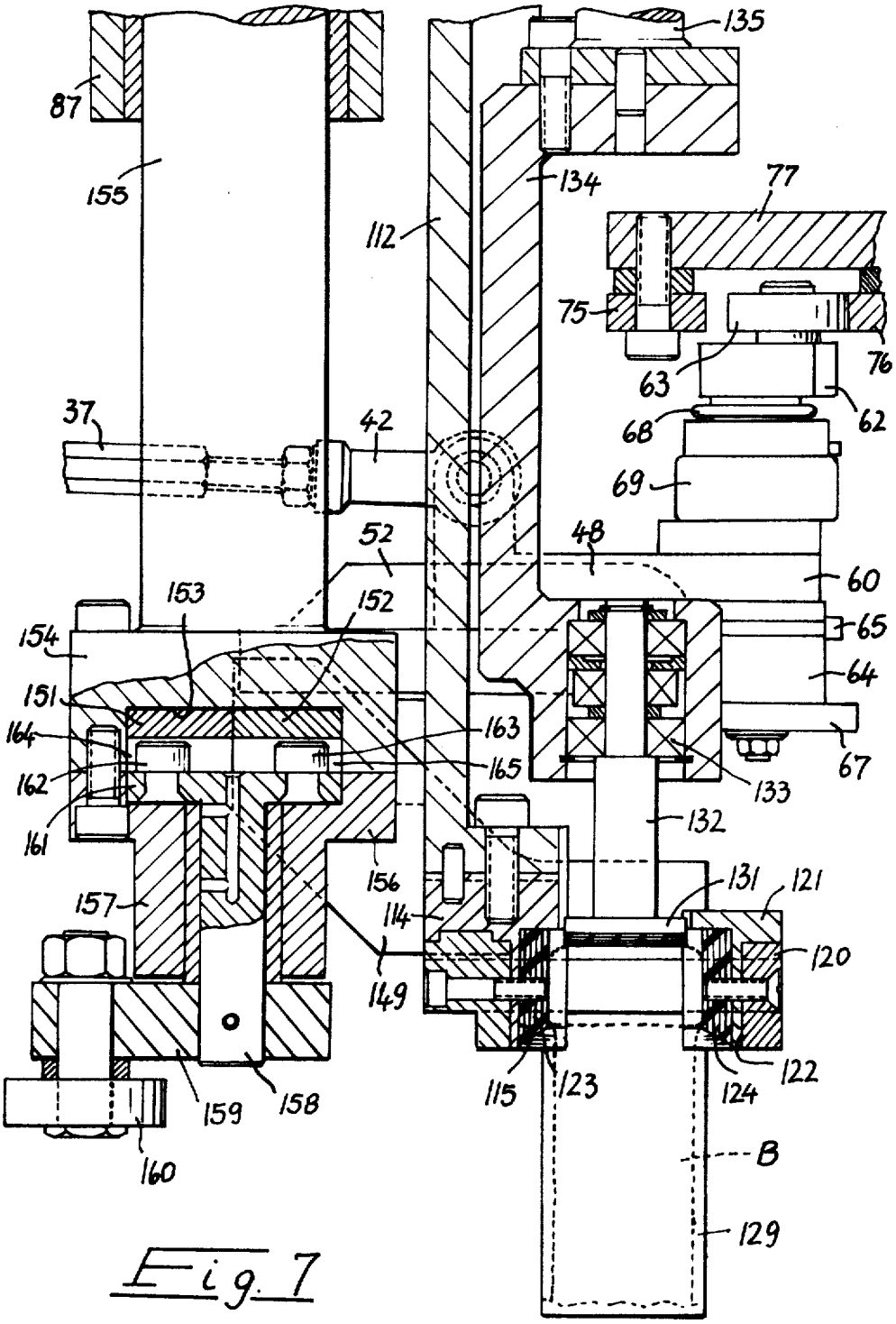
FIG. 7 is an enlarged scale view of the parts enclosed within the rectangle represented with dash and dot lines in FIG. 1.

The cited outer and inner cams for actuating the clamps 65,66 and 71,72 are indicated at 75 and 76 in FIG. 7 and are mounted to an arm 77 in turn secured to the base of the vertical pillar 78. The pillar 78 has its top connected by an arm 79 to a stationary cover 80, which is attached to parts derived from the machine base or bed (FIG. 1), not shown. The positioning of the clamp members in the two operative positions is determined by adjustable detents 81,82 (FIG. 4), consisting of screws affixed to the outer edge of the plate 10 and below the latter close to the opening 55. Onto the tube 3, there is centered a further tube 83 coaxial to the shaft 1 and provided with a flange 84 at one base. Between the flanges 5 and 84, there is clamped, by means of bolts 85, a disk 86 wherein, along a radial line to the shaft 1, two holes are formed for the insertion of two vertical sleeves 87,88 which rest onto the disk 86 with the interposition of spacer rings 89,90 located between the collars of said sleeves and the disk 86, and secured by means of screws.

Onto the tube 83, through bearings 91,92, a drum 93 (FIG. 1) is supported pivotally, the drum being provided at its opposite ends with flanges 94,95 and, at intermediate positions, with a collar 96. The cited cover 80 is attached to the flange 94, and two respective rims 97,98 are attached to the flange 95 and collar 96. Along the periphery of the rim 97, there is secured an axial cam 99 the upper edge whereof constitute the active profile. Two further axial cams 100,101 are secured along the periphery of the rim 90, and their upper and lower edges represent the active profiles.

The cams 99,100,101, being rigid with the drum 93, in turn affixed to the cover 80, are stationary with respect to the disk 86 and plate 10, which instead rotate because they are driven by the shaft 1.

Within the sleeve 88, by means of antifriction bushings, is slidable a tube 102, the upper end whereof projects above the sleeve 88, its opposite end extending below the disk 86.

At the upper end (FIG. 2), there is arranged a ring 103 which carries cantilever fashion two arms 104,105 aligned diametrically. From the ends of the arms 104,105, there depend two rods 106,107, parallel to each other and to the sleeve 88, such rods being guided in holes in the disk 86. Compression springs 108,109 are engaged with the rods 106,107 which, intervening between the disk 86 and arms 104,105, are effective to hold the ring 103 tightly against a resilient ring 110 recess mounted in an annular groove in the tube 102, thus urging the latter upwardly. In the ring 103, on the side facing the drum 93, there is mounted cantilever fashion an idle roller 111 (FIG. 1) which, under the influence of the springs 108,109, is held in rolling engagement with the edge of the cam 100.

At the lower end of the tube 102, below the disk 106, there is formed an angle bar element 112 which extends, with an extension thereof, downwardly and supports a frame 113, best shown in FIG. 5 and suitable to support the bottle at its top during the application of the fiscal band.

The frame 103 comprises a body 114 attached to the lower end of the angle bar 112 and having a nearly hemicylindrical cavity 115 open downwardly and outwardly. From the body 114, there extend, in opposite directions and tangential to the shaft 1, two arms 116,117 to the end portion whereof are attached two stringers 118,119 interconnected by an element 120 which, at a middle position, carries a body 121. In the body 121, at an opposite location to the body 114, there is formed a cavity 122 (FIGS. 6 and 7) which is a mirror image of the cavity 115. The cavities 115 and 122 form a seat that may be superimposed on the top of the container and are lined internally with linings 123 and 124 of a plastic material such as not to damage the top of the bottle, which is known to be generally pre-covered with a sort of hood of metal foil.

As may be seen more clearly in FIG. 6, the bodies 114 and 121 are spaced apart from each other such as to define an opening suitable to allow the fiscal band 58 therethrough, the length whereof will be preferably less than the distance between the stringers 118,119. The arms 116,117 and the element 120, on the sides of the bodies 114,121, have cut outs 125,126 and 127,128 which define widenings for allowing two pads 129,130 therethrough, the pads being effective to fold the opposed laps of the band 58 onto the bottle neck. During the descent of the pads 129,130, the band 58 is retained at the top ofthe bottle by a pad 131 (FIGS. 1, 2, and 7). That pad 131 is rigid with the lower end of a stem 132 pivotally supported, with the interposition of bearings 133, by an adapter or bush which is integral with a C-shaped element 134 secured to a stem 135 which is guided axially in the tube 102. To the stem 135, there are affixed, at a middle position, two diametrically aligned arms 136,137 which extend outwardly through slots extending longitudinally in the tube 102 and in the sleeve 88. The slots of the tube 102 are indicated at 138 and those in the sleeve 88 are indicated at 139. In order to prevent the stem 135 and tube 102 from rotating, the arms 104,105 and 136,137 are guided in links 140,141 secured to the sleeve 88.

The upward and downward movements of the stem 135 are controlled by the rolling of a roller 142 (FIG. 1), mounted cantilever fashion to the top of the stem 135, on the cam 101. The roller 142 is held in engagement with the cam 101 by the pull applied by a pair of springs 143,144 hoked with one end to the free ends of the arms 136,137 and with the opposite end, after passing through openings in the disk 86, to pins 145,146 secured to brackets 147,148 which project downwards from the disk 86 whereto they are rigid.

The pads 129,130 (FIG. 3) are of a resiliently yieldable material and extend in height for a distance at least equal to the length of the opposed laps of the band 58. The pads 129,130 are attached to plates affixed to the arms 149,150. These arms are rigid with sliders 151,152 of rectangular cross section which are guided, one adjacent the other, in a seat 153 of a block 154 provided at the lower end of a stem 155 which is guided in the sleeve 87. The seat 153 is closed at the bottom by a member 156 attached to the block 154 by means of screws. The member 156 has in alignment with the stem 155 a bushing 157 wherein a pintle 158 is supported pivotally. Onto the end of this latter, extending downwardly from the bushing 157, a lever 159 is pinned which carries an idle roller 160 pivotable about a vertical axis and adapted to engage with the outer profile of the cam 20. The end of the pintle 158 which extends to the inside of the seat 153 is provided with a plate 161 whereon the sliders 151,152 rest. From the plate 161 project two pins 162,163, in diametrically opposed positions, which engage in grooves 164,165 formed in the lower face of the sliders and perpendicular to the sliding movement direction of the latter. By virtue of the cam 20, the tail piece 158 performs oscillatory movements which determine, through the pins 162,163, the entrainment of the sliders 151;152 in opposite directions and, accordingly, the pad approaching or moving away. When the pads are brought closer—as controlled when the latter have penetrated the frame 113 and folded downwardly the opposed laps of the fiscal band resting on the cap and retained thereon by the pad 131—said laps are pressed against the bottle neck in order to ensure a perfect adhesion thereof.

The upward and downward strokes of the pads are controlled, as indicated, by the cam 99. To this purpose, the stem 155 is provided, at its top, with a ring 166 which carries, facing inwardly, an idle roller 167 (FIG. 1) in rolling engagement with the upper profile of the cam 99. The restraint to rotation of the stem 155 is obtained by engaging a pair of radial arms 168, normal to the axis of the roller 167, in respective links 169 attached to the disk 86, while the resilient engagement of the roller 167 on the cam 99 is afforded by tension springs secured with one end to the arms 168 and with the other end to the disk 86. It will appear how, although not shown in detail, the measurements relative to the locking of the stem 155 against rotation and to the resilient engagement of the roller 167 on the cam 99 are entirely similar to those adopted for the stem 135.

The labelling machine illustrated in FIGS. 1 to 7 operates as follows.

It is assumed that the machine is at a cycle situation where the stem 155 and tube 102 are in a raised position, the carriage 23 is in a retracted position, i.e. closer to the shaft 1, and the pad 131 is resting on the top of a bottle B (FIG. 7) such as to hold it clamped against a bottom plate which is integral with a surface driven to rotate by the shaft 1. In such a situation, the rollers 63,73 controlling the clamps 65,66 and 71,72 lay on horizontal planes, in engagement with the cams 75,76 and the clamps themselves which are tilted outwards and in the open condition. As the shaft 1 rotates, the rollers 63,73 leave the cams 75,76 and, under the influence of the springs 68, cause the clamps 65,66 and 71,72 to close and grip the opposite ends of a fiscal band 58 delivered by a mechanism not shown which, in a known manner, has picked it up from a magazine for storing a pack of fiscal bands. Thus the position of the clamp members 56,57 is the one shown in FIG. 3, where the fiscal band 58 presents its face carrying the adhesive and intended to contact the bottle facing outwards. In order to allow the application of the fiscal band to the top of the bottle, the frame 113 is lowered such that the top of the bottle B engages the seat defined by the linings or gaskets 122,123. As the bottle is firmly held between the frame 113 and the bottom plate, the pad 131 is controlled to move upwards and the carriage 23, under the influence by the cam 21, is displaced radially outwards along the guides 26,27. The rods 36,37 act on the levers 47,48 which, by rotating about the pins 49,50, tilt or invert the clamps 65,66 and 71,72 such that the fiscal band 58 is disposed horizontally below the pad 131 now raised and above the frame 113. At this moment, as the shaft 1 rotates further, the stem 135, under the influence by the springs 143,144, is forced to move down such that the pad 131 is allowed to act on the band 58 at a central location, properly stretch the band 58, and then press it against the bottle top (FIG. 2). On completion of this operative step, the pads 129,130 are caused to move down owing to the lowering of the stem 155 which, with the roller 167 and under the tension applied by the springs acting on the stem 155, follows the profile or contour of the cam 99. The pads 129,130 are spaced apart (FIG. 3), and their arms 149,150, during the downward stroke, act upon two cams 67,74 which open the clamps 65,66 and 71,72 thus releasing the opposed ends of the band 58. Then the pads, as they further their downward movement, fold the opposed laps of the fiscal band downwardly astride the top of the bottle and longitudinally along the neck thereof. Upon the pads reaching their bottom stroke end, the roller 160 is located in the plane of the fixed cam 20. As the shaft 1 rotation continues, the roller 160 is put in contact with the outer profile or contour of the cam 20 which causes the tail piece 158 to rotate and accordingly also the pins 162,163, the pins entraining one against the other the sliders 151,152. The pads 129,130 attached thereto are thus pressed onto the neck of the bottle such as to cause the opposed laps of the fiscal band to adhere at all points. The subsequent operative steps of the labelling machine contemplate the moving apart and raising of the pads 129,130, then the tilting outwardly of the clamps 65,66 and 71,72 which, on contacting the cams 75,76 will open in readiness for a fresh fiscal band. Finally, the frame 113 will be raised. However, it will be apparent that the operations just described may also be carried out in a different order according to the cycle time when the fiscal band is to be applied. It will be recognized that the invention fully achieves its objects.

In particular, it should be noted that when the top of the bottle is held in the frame 113, it is possible to effect a rotary positioning of the bottle such as to lay the fiscal band in any desired orientation. The bottle is in any case firmly retained, and any unbalance, as due to the centrifugal force developed by the carousel rotation, will have no effect thereon. Moreover, the ability to lock the bottle with the pad 131 alone, permits the carrying out of any other labelling operation on the bottle, and especially those which contemplate a rotation of the bottle about its own axis.

Figure 9:
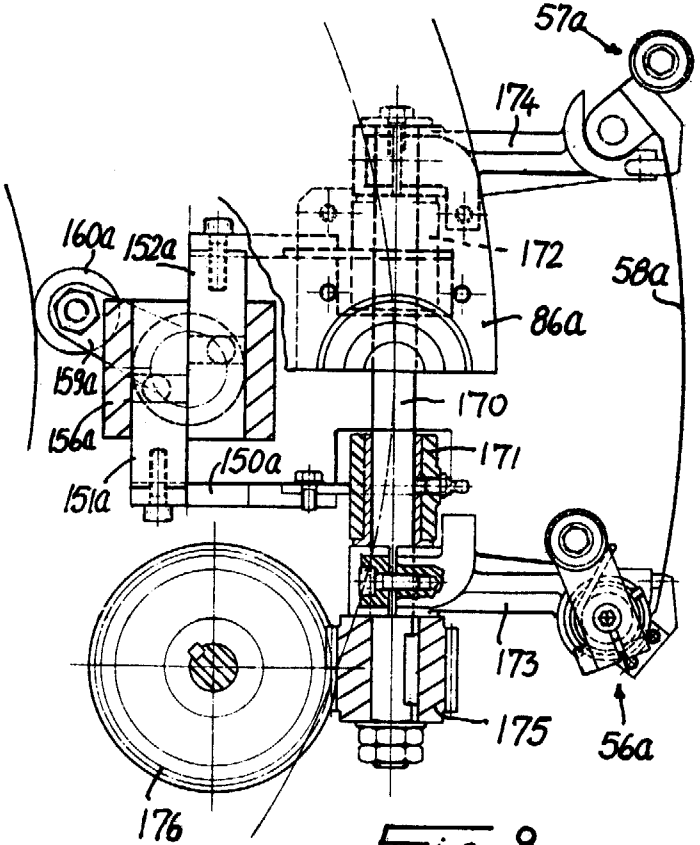
FIGS. 8 and 9 are elevational section and respectively plan views of another embodiment of this invention.
Figure 8:
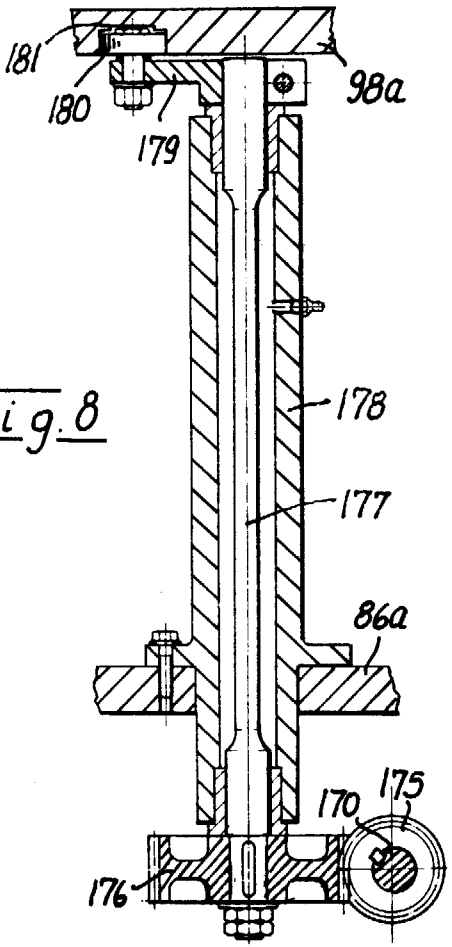

The invention, as described hereinabove, is susceptible of many modifications and variations, all of which fall within the scope of the invention. The embodiment illustrated in FIGS. 8 and 9 (where those elements which are the equivalent of the elements of the embodiment shown in the preceding figures are denoted with the same reference numerals but carrying the suffix character "a") contemplates, for actuating the clamps gripping the opposed ends of the fiscal band, a device comprising a shaft 170 rotatably journaled on a pair of brackets 171,172 attached under the plate **86*a*. To the shaft 170, there are keyed two arms 173,174 which carry the clamp members 56*a* and 57*a* and a gear wheel 175. The wheel 175 meshes with a gear wheel 176 keyed to the lower end of a vertical shaft 177 supported by a sleeve 178 carried by the disk 86*a*. To the top of the shaft 177 extending outwards from the sleeve 178 there is pinned a lever 179 which carries an idle roller 180 in engagement with a groove 181 formed in the cover 98*a*. The groove 181 is so patterned as to cause the shaft 177 to execute a rotation which, through the gear 175,176, determines a rotation by approximately 90° of the arms 173,174, and accordingly a displacement of the fiscal band 58*a* from the pick up position to that of positioning onto the bottle top. It should be further noted that in the embodiment of FIGS. 8, 9 the shaft 170** is led inside the C-like element which carries the bottle clamping pad. It will be evident how in practicing the invention all the elements may be replaced with other technically equivalent elements. Furthermore, the shapes and dimensions may be any ones to suit individual requirements.

I claim:

1. A labelling machine for applying a sealing label on the top of a bottle comprising a carousel rotating about a vertical axis and having pivotal bottle supporting plates, a plurality of clamp members mounted on said carousel and adapted to grip the opposite ends of a label delivered from a magazine, frame members supported on said carousel and each defining a cylindrical seat diametrically slotted to form an opening for the passage of a label, means for actuating said frame members so as to bring said seats in engagement on the bottle tops, means for actuating said clamp members between a label pick up position and a position at which said label is placed on the top of the bottle, vertically movable press members controlled so as to penetrate said opening to clamp the label on the bottle top and to fold down the opposite ends of the label on the bottle neck, wherein each clamp member comprises a lever pivoted about a horizontal axis tangential with respect to the carousel axis of rotation, said lever supporting pivotally a pin carrying a finger, said pin being subjected to elastic means tending to hold said finger in contact with an abutment or detent in said lever such as to form a clamp and to cam means controlling the rotation of said pin in opposition to said elastic means for opening the clamp, said lever being controlled through a tie bar by a slide guided radially on said carousel and connected to cam means adapted to cause the lever to rotate from a label pick up position to a position at which said label is placed on top of a container.

2. A machine according to claim 1, characterized in that said clamp members comprise a pair of levers pivoted onto a horizontal shaft tangential with respect to the carousel axis of rotation, to said levers there being rigidly connected respective fingers cooperating with detents such as to form a clamp, to said shaft there being keyed a gear wheel meshing with a further gear wheel rotatively rigid with a shaft pivotally supported parallel to the carousel rotation driveshaft, said shaft being controlled by a cam.

* * * * *